US006695516B2

(12) United States Patent
DeFields et al.

(10) Patent No.: US 6,695,516 B2
(45) Date of Patent: Feb. 24, 2004

(54) FLOOR FINISH APPLICATION SYSTEM USING APPLICATOR PAD AND MATCHED FLOOR FINISH COMPOSITION

(75) Inventors: Scott DeFields, Oakdale, MN (US); Scott Olson, Mahtomedi, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 09/992,195

(22) Filed: Nov. 14, 2001

(65) Prior Publication Data

US 2003/0091379 A1 May 15, 2003

(51) Int. Cl.[7] ..... A47L 13/26
(52) U.S. Cl. ..... 401/139; 401/137
(58) Field of Search ..... 401/139, 137, 401/48, 270, 279, 281, 289, 282

(56) References Cited

U.S. PATENT DOCUMENTS

| | | | | |
|---|---|---|---|---|
| 2,234,805 A | * | 3/1941 | Parks | 401/139 |
| 4,152,084 A | | 5/1979 | Melton et al. | |
| 4,372,312 A | | 2/1983 | Fendler et al. | |
| 4,865,596 A | | 9/1989 | Weisman et al. | |
| 4,971,471 A | * | 11/1990 | Sloan | 401/203 |
| 5,763,065 A | | 6/1998 | Patnode et al. | |
| 5,782,991 A | | 7/1998 | van Der Heyden et al. | |
| 5,897,410 A | | 4/1999 | Ferraro | |
| 5,920,944 A | | 7/1999 | Biggs et al. | |
| 6,017,163 A | | 1/2000 | Keppers et al. | |
| 6,045,622 A | | 4/2000 | Holt et al. | |
| 6,131,233 A | | 10/2000 | Bolton et al. | |
| 6,394,683 B1 | * | 5/2002 | Pao | 401/289 |
| 6,550,998 B1 | * | 4/2003 | Fernschild et al. | 401/48 |

FOREIGN PATENT DOCUMENTS

| | | |
|---|---|---|
| EP | 0 461 873 A2 | 12/1991 |
| WO | WO 00/54647 | 9/2000 |

OTHER PUBLICATIONS

"MicroFiber Multi–Mop Set w/2 pads"; http://store.hhshopping.com/sku465.html; 1 page (Printed Oct. 25, 2001).

"Amazing Microfiber Cloth—Use and Care—microfiber products"; http://www.amazingcloth.com/generic.html; 2 pages (Printed Oct. 25, 2001).

"Amazing Microfiber Cloth—Microfiber Mops—Extra Pad for Amazing Mop"; http://www.amazingcloth.com/item.jhtml 1 page (Printed Oct. 25, 2001).

"Microfiber Pads"; http://www.goclean.com/products/detail.cfm; 1 page (Printed Oct. 25, 2001).

"What is Microfiber?"; http://members.aol.com/swedeclean/whatis.htm; 1 page (Printed Jul. 26, 2001).

"Master of Microfiber cloths in the world!!!"; http://www.ec21.net/co/c/cleanhouse/prod_group.html; 2 pages (Printed Jul. 26, 2001).

"About Microfiber Function . . . "; http://www.jintex.com/microfiber–frame.htm; 3 pages (Printed Jul. 26, 2001).

"Microfiber"; http://www.theragcompany.com/microfibers.htm; 2 pages (Printed Jul. 26, 2001).

* cited by examiner

*Primary Examiner*—David J. Walczak
(74) *Attorney, Agent, or Firm*—Merchant & Gould P.C.

(57) ABSTRACT

A system for the formation of a thick robust transparent floor finish layer from a high solids formulation with an applicator device utilizing micro fiber technology. A micro fiber applicator device can be configured to apply a sufficient amount of an aqueous high solids floor finish to obtain a thick robust finish layer in a single application. One system for applying the floor finish can comprise a source of aqueous floor finish and an applicator wand comprising an application nozzle and application surface. Application surface can comprise micro fiber technology in a pad structure comprising a reservoir foam and a micro fiber applicator surface.

25 Claims, 11 Drawing Sheets

FLOOR FINISH APPLICATION SYSTEM USING APPLICATOR PAD AND MATCHED FLOOR FINISH COMPOSITION

FIELD OF THE INVENTION

The invention relates to a portable apparatus that can be used to distribute a high solids floor finish on a floor surface. The apparatus is adapted for high solids aqueous floor finish compositions that can be distributed to form a single robust layer of floor finish in one application on a resilient vinyl floor. In a preferred format, the system involves a backpack adapted for a single user, wand applicator having an application nozzle, an applicator pad, a high solids content aqueous finish composition and means to meter the correct amounts of floor finish.

BACKGROUND OF THE INVENTION

The application of aqueous floor finish compositions to institutional floor surfaces in particular to resilient vinyl flooring remains a difficult problem for floor maintenance personnel. In the past floor finishes have been applied using multiple applications of conventional floor finish compositions to build up a robust finish layer. Such manual applications are often accomplished by pouring liquid floor finish or metering liquid floor finish onto a surface and uniformly distributing the liquid floor finish using a mop, weighted "T" bar, or other application device. Such application techniques often result in an uneven application, undesirable flawed surface appearance, unnecessary labor costs and often can result in insufficient thicknesses for commercial flooring. We have found that mobile or portable apparatus for floor maintenance are known. For the purpose of this application, we are not interested in an apparatus adapted for floor cleaning protocols. In the cleaning art, the mobile technology typically involves the use of aqueous cleaners and rinses for removing soils, low solids floor finish compositions and other undesirable materials from floor surfaces.

Conventional aqueous floor finish compositions are formulated in a variety of product types. The products vary with respect to the type of materials combined in the formulations and with respect to the amount of solids found in the formulations. The use of high solids floor finish compositions poses unique problems. Application technologies developed for conventional low solids floor finish compositions are often inadequate when used in high solids applications. Further the conventional application techniques cannot take advantage of the unique properties of high solids floor finish materials. Substantial need has arisen for improved methods and equipment that can be used in applying high solids floor finish materials.

We're aware of the following patents generically related to floor maintenance technologies. Gewalt (U.S. Pat. No. 2,053,282), Thompson (U.S. Pat. No. 2,061,216), Payne (U.S. Pat. No. 2,731,656), Minerley (U.S. Pat. No. 2,875,463) and Cushing (U.S. Pat. No. 4,119,386) disclose an apparatus typically characterized in the prior art as "a fountain mop." Such systems comprise typically a wand having mounted thereon, a reservoir for an aqueous material that can be applied through a "fountain" and a mop head that can be used to distribute the aqueous material. Similar to such fountain mops, Floyd (U.S. Pat. No. 1,778,552), Burfield (U.S. Pat. No. 4,984,328) and Sloan (U.S. Pat. No. 4,971,471) each teach a mop or brush head that includes a spray system for introducing an aqueous material into the head or on a floor.

One common configuration of a typical mobile floor cleaning system is the portable or motor driven cleaning machine such as that shown in Girman et al. (U.S. Pat. No. 4,893,375) or Tipton (U.S. Pat. No. 5,331,713) these apparatus are configured to sequentially apply cleaning materials to a floor, scrub the floor and then remove the cleaning materials for further operations.

Keppers, et al. U.S. Pat. No. 6,017,163, teaches a wheeled portable floor finish distribution apparatus mounted on a wheeled cart using an applicator nozzle, wand and distributor device to apply aqueous floor finish compositions.

A brief review of these disclosures show that no system is available that is adapted for the convenient, efficient application of a liquid floor finish over a large area floor using a portable cart system. Available application systems are not adapted to take advantage of the unique properties of high solids floor finish compositions. The larger portable or motor driven prior art systems are adapted for the serial application and removal typically by vacuum systems of aqueous materials used to wash, rinse or maintain floor surfaces.

Conventional technologies are not truly adapted for a single user performing the application of a single robust floor finish layer from high solids materials. In large part the prior art is directed towards portable systems that clean large areas of institutional flooring, but not directed towards applying maintaining floor finish layers.

A substantial need exists for apparatus and methods adapted to the formation of a single robust floor finish layer by a single maintenance individual using high solids floor finish compositions.

BRIEF DISCUSSION OF THE INVENTION

The invention relates to a floor finish application system including a source of aqueous floor finish in fluid communication with an applicator wand. The applicator wand comprises a handle, metering means for the high solids floor finish applicator nozzle, a distribution pad and a high solids aqueous floor finish composition. In the invention, a distribution pad using microfiber technology is paired with a high solids aqueous floor finish to permit a single applicator individual to apply a single coat, thick, robust floor finish in a single application or pass. In a preferred embodiment, the floor finish in a flexible container is placed into a backpack housing. The flexible container is equipped with a tubular connector such as a conduit that can be attached to the applicator wand structure. The wand structure can comprise a conduit directed to a floor finish applicator nozzle that can be used to meter an appropriate amount of the floor finish composition onto the resilient vinyl floor surface. The wand structure also comprises an attached micro fiber pad that can be used to distribute the aqueous finish at an appropriate rate of application in an appropriate application amount for a single pass application of the thick floor finish layer. For the purpose of this patent application, the term "resilient vinyl flooring" refers to conventional commercial flooring materials commonly found in commercial establishments such as large retail stores.

BRIEF DESCRIPTION OF THE DRAWINGS

FIG. 8 protects the applicator metering means and applicator nozzle with an installed pad on an installation surface attached to the wand. In FIG. 8, one embodiment of the installation of the pad on the applicator surface-using pad pockets installed in the pad is shown for attachment of the pad to the wand assembly.

DETAILED DISCUSSION OF THE INVENTION

Figure 1:
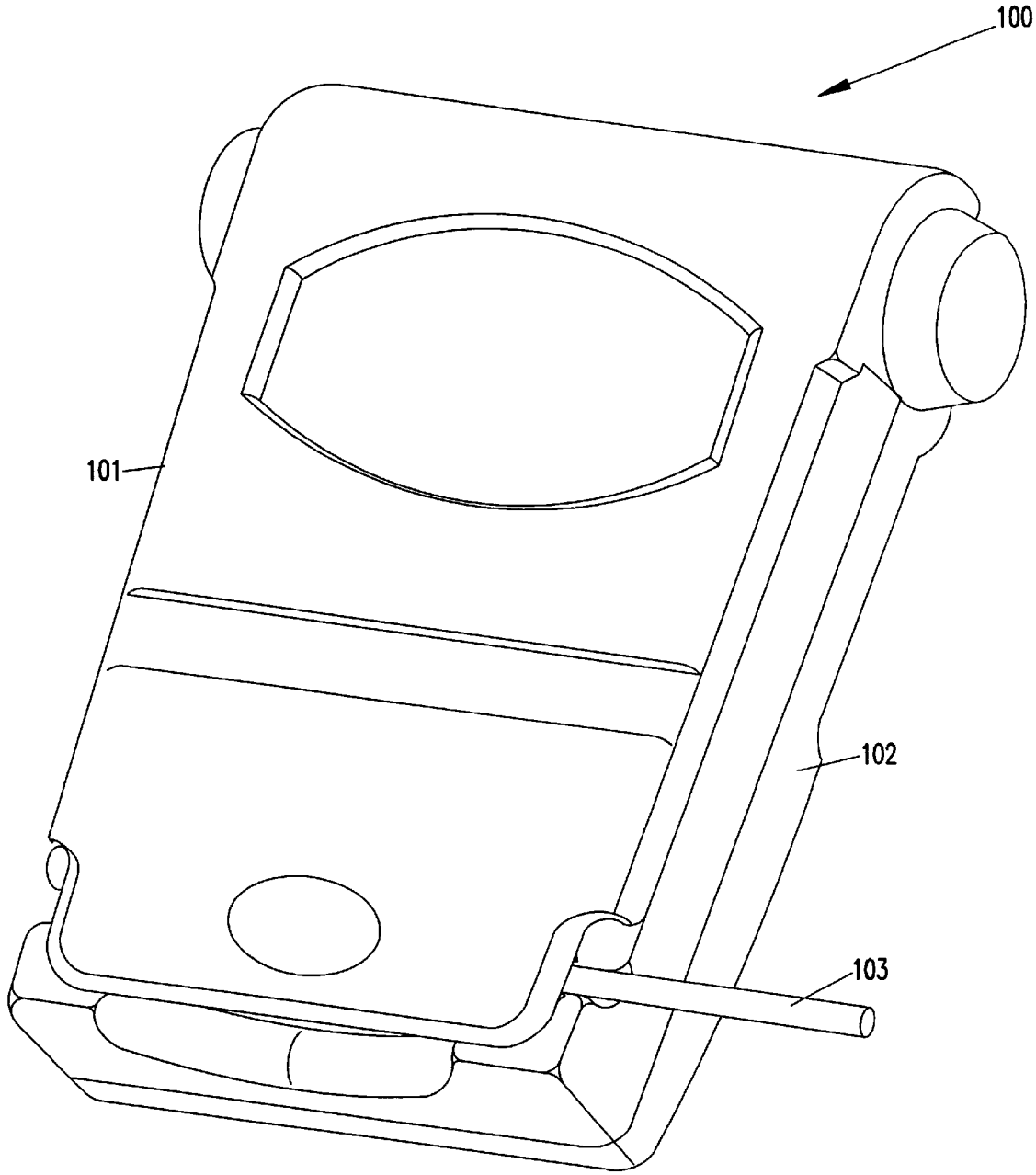
FIG. 1 is a depiction of the portable application unit or back pack of the invention capable of containing the liquid finish material preferably in the form of one or more flexible containers of floor finish liquid.

The floor finish system of the invention involves a portable reservoir for the floor finish such as a portable system adapted for a single user. Such a portable system can comprise a back pack system that can serve as a mounting location for a container of the high solids floor finish of the invention. The portable reservoir or back pack and the included floor finish or floor finish container is fluidly connected to an application wand having a fluid conduit leading to a metering tip and applicator pad. The application wand contains metering means that permits the user to apply an appropriate amount of floor finish to the resilient vinyl floor surface. Such means can be incorporated into the handle used by the user of the application wand. In a preferred embodiment, the individual user of the system can apply, in a single application of high solids floor finish, a thick robust layer of floor finish on a floor surface.

The portable reservoir or back pack is equipped with attachment means appropriate for the use of the application personnel. Typically the back pack structure is worn by the application personnel using a shoulder strap or harness configuration applied to the user's back. The portable reservoir, however, can be used in a variety of configurations including as a chest pack, as a "fanny pack," or any other configuration that can be supported by application personnel during floor finish application operations. The back pack container can be configured to enclose a flexible or rigid, inflexible container filled with an appropriate amount of high solids floor finish.

The portable reservoir or back pack should be configured such that it can be easily used by the application personnel over an eight hour period (including multiple fillings or replacements of the floor finish material) conveniently without fatigue. Accordingly, the filled portable reservoir or back pack should weigh no more than about 1.5 kg, but should contain at least 5 liters of floor finish with a maximum capacity of about 15 liters. The portable reservoir or back pack should be configured for easy refilling or access to the interior of the back pack. Access can permit removal of empty containers of floor finish and the insertion of new filled containers. In one embodiment, the back pack can simply be filled from a reservoir of floor finish without a separate container structure. However, preferably, the back pack is configured to receive and support a container of floor finish. Preferably, the floor finish container is a flexible container, a semi-rigid or rigid container that is adapted to the interior space of the back pack. The container is simply inserted into the back pack without significant modifications to the back pack structure. However, in a preferred embodiment, the back pack contains interior access having a closure structure that can be opened and closed during operations in which the empty containers are replaced by filled containers. In a preferred embodiment, an openable door or lid structure is installed in the back pack exposing the interior of the back pack to easy access to the empty containers and for insertion of a new filled container.

The interior of the portable reservoir or back pack is sized and configured for filling with liquid floor finish or configured to accept and support the fluid floor finish container. The container should have a "lock and key" structure such that only an appropriately shaped floor finish container can be effectively inserted into the recess within the back pack that can accept and support the back pack container. The surface of the container that contacts the portable reservoir or back pack wall or support surfaces should have a unique profile such that only containers adapted to that profile will fit the interior space of the portable reservoir or back pack. The container can have a unique surface that comes into contact with the support structure in the back pack or can have a unique surface on the side of the container that comes into contact with the interior space of the back pack. Such profiles can include protruding areas, indents, or an overall shape or profile adapted to the interior space of the back pack. Depending on application, the back pack can be configured to include two or more separate containers that can contain either the identical floor finish composition, combinable two-part floor finish compositions or different floor finish compositions, depending on application.

The portable liquid floor finish system of the invention includes a conduit that can act as a means of fluid communication directing the floor finish from the back pack to the wand used to apply the floor finish. In a preferred embodiment, a coupling is installed in the floor finish container that directs the floor finish from the container to the attached conduit structure. The conduit structure is coupled with a conduit installed on the application wand in conjunction with the metering valve and pad. The back pack can be adapted for use by both right handed and left handed individuals and for right handed and left handed use regardless of the handedness of the individual. The conduit leaving the back pack can be installed in a right aspect or a left aspect using a conduit restraint structure formed in the portable liquid floor finish system for ease of use and application in all environments by all users. In a preferred mode, the container is permanently installed with the conduit and when the container and conduit are installed in the back pack with a fresh amount of high solids floor finish, the conduit is directed from the container. The conduit leading from the coupling can be placed in a conduit restraint formed in the back pack case that prevents the two from undesirable or inappropriate motion.

Once installed in the back pack, the container conduit is in turn connected to a conduit installed on the application wand that leads directly to the application metering valve structure. The container conduit can be joined with the wand conduit using common joiner means including a connector or coupling providing fluid communication from the container to the wand floor finish application means. The conduits leading to the metering structure are size and configured to ensure that the application wand can direct a substantial quantity of liquid floor finish onto the floor. For preferred operations, the back pack is structured and adapted to apply about 10 milliliters to about 120 milliliters of floor finish per square meter of floor, preferably about 30 milliliters to about 100 milliliters of floor finish per square meter of floor. Such an add-on will ensure a thick, resilient and robust coating on the floor surface. Such an add-on amount will obtain, in a single dried application layer, a layer thickness, after evaporation of the liquid carrier fluid, that ranges from about 0.01 to about 0.03 millimeters, preferably about 0.005 to about 0.05 millimeters. The floor finish structure of the invention is adapted to permit the relatively rapid application of floor finish to the resilient vinyl floor surface. Accordingly, during preferred operations, a skilled applicator can apply the desired amount and thickness of the floor finish at a rate of about 3.0 to about 10 square meters per minute of operation.

The application wand of the invention is adapted for easy metering of an appropriate amount of the floor finish to the resilient vinyl floor surface and to distribute the aqueous finish in an appropriate thin continuous layer. In a preferred embodiment, the wand has, on a proximal end a handle and on a distal end attachment means for the application pad. Proximate to the application pad is installed a metering valve or orifice that is connected to triggering means in the handle of the wand. The wand additionally comprises a conduit that can provide fluid communication for the liquid floor finish from the back pack container or reservoir to the metering orifice proximate the pad. In a preferred mode, the application personnel will trigger the flow of floor finish until an appropriate amount is applied to the floor proximate the pad by manipulation of the application means installed in the handle structure. The pad then is used to first acquire within the pad interior foam reservoir, an amount of the floor finish. Once substantially saturated with liquid floor finish, the pad is then worked across the floor surface to evenly distribute the floor finish in a thick layer. The pad can be worked in a variety of patterns along the floor surface. The pattern selected can be appropriate for the personnel and for the space involved. For example, relatively narrow hallways can be serviced by a linear back-and-forth application, however, large square areas can also be worked by an arc-like or semicircular-like application pattern. However, the preferred mode involves the application of a sufficient amount of floor finish since that a thick resilient robust coating is formed in a single application on the floor surface.

The proximal end of the floor application wand typically contains a handle and a triggering means to apply the floor finish, virtually any type of means to meter or apply the floor finish can be used in the handle. Common lever or trigger structures that are operably connected to the application nozzle can be used. The structure selected should be easily adapted to the application of the appropriate amount of floor finish to the floor surface. The application wand typically comprises a conduit that passes from the back pack along or within the handle leading down to the application nozzle. In a preferred embodiment, the conduit leaves the back pack, is then connected to the conduit in the wand using a coupling conveniently placed for easy attachment to the conduit on the handle. The conduit is then directed to the metering structure.

The conduit can be mechanically associated with the wand in a variety of ways. The conduit can be installed within the tubular wand structure, can be attached along the exterior length of the structure using mechanical fasteners or the conduit can be wound around the wand to maintain a loose association of the conduit and the wand. The conduit typically ends at a metering structure installed at the distal end of the metering wand. The metering structure is typically installed on the distal end of the application wand such that the liquid floor finish can be applied without substantial splashing. The metering structure is operably connected to the handle application means for the appropriate application of the aqueous floor finish. The metering structure can comprise any valve-like structures for the measured application of the appropriate amounts of floor finish. In the preferred embodiment of the invention, the desired volume of floor finish can be selected by actuating the metering structure that can include simple on/off valves, mechanically or electrically driven valves or other structure.

One important aspect of the metering structure involves the diameter of the output orifice that is used to meter the appropriate volume of floor finish. The output metering structure typically has a diameter of about 0.05 to 0.1 millimeters, preferably about 0.03 to 0.2 millimeters for appropriate add-on of floor finish. The application wand terminates at its distal end with an application pad. The application pad is installed in an articulating position at the end of the application pad to provide rotation about to the end of the wand to maintain contact between the application surface of the pad and floor surface. Such an articulating position can be achieved by the use of a flexible linkage that ensures that the pad is in contact with the floor over the entire application surface of the pad. A variety of structures can be used to attach the pad in a flexible articulated manner to the distal end of the application wand.

The application pad of the invention is adapted to be easily installed onto the distal end of the application wand, to act as a reservoir for a significant proportion of the liquid floor finish and to have an appropriate surface area to distribute the liquid floor finish across the floor in appropriate amounts such that the floor finish can be applied at a single application to result in a thick robust continuous floor coating.

One important aspect of the pad is its ease of use. The movement of the pad should provide as little resistance to the application of the floor finish as possible for the convenience and comfort of the individual using the floor finish application system. Accordingly, the pad should be sized and configured such that the resistance to movement of the pad with the fluid floor finish across the floor is minimized. Such a pad will be easy to use, will apply floor finish in the appropriate amounts but not result in substantial fatigue to application personnel that would interfere with the appropriate add-on amount of floor finish. In our work, we have found that a pad having an application surface that ranges from about 500 to about 2000 square centimeters provides an appropriate application surface that results in a high quality floor finish and minimum fatigue in the application personnel. The profile of the application surface can be generally rectangular, oval, circular or other appropriate structure. In a preferred mode, we have found that the preferred pad is a generally rectangular pad wherein the length of the pad is generally 2 to 6 times the width of the pad. Preferred pads have a dimension of about 10 to about 20 centimeters in width and about 50 to 100 centimeters in length. The pad can be attached to the distribution wand using a variety of techniques. The pad can have pockets or inserts installed in the attachment surface of the pad which can interact with mechanical devices on the wand to ensure a close fitting association with the wand structure. In one embodiment, the wand can have a flexible structure that can be inserted into pockets formed in the pad that can be used to attach the pad to the wand. In an alternative embodiment, the pad can have an attachment surface having a VELCRO® (hook and loop fastener) structure that can simply be pressed against the corresponding surface at the distal end of the application wand for reliable installation. The application pad typically comprises the attachment surface, an internal foam reservoir and on the surface opposite the attachment surface, an application surface with a microfiber distribution structure.

The pad is typically manufactured by loosely assembling the attachment surface, the interior foam pad and the microfiber application surface and then mechanically attaching the layers one to the other in a laminate structure. A variety of attachment means can be used including hot melt adhesives, hot line lamination or sewing. In a preferred mode, the layers are assembled by sewing the pad along its length and along its perimeter to ensure close association with the layers.

The application surface has an installed microfiber distribution means. The use of microfibers on the application surface ensures that the foam reservoir, the applied floor finish and the application surface cooperate to apply a large quantity of the floor finish to the surface resulting in the robust floor finish layer. The microfibers are installed in the pad with a preferred alignment. The microfibers are typically placed in or installed in a pad support structure in a direction that is substantially normal to the surface of the pad. In other words, as the pad is moved across the floor, the microfibers are substantially perpendicular to the floor surface. It should be understood that, however, the microfibers are highly flexible and will move in accordance with the net force applied by the application personnel. Accordingly, the microfibers will contact the floor finish and the floor surface during application and will be moved in accordance with the motion of the pad. However, the microfibers are substantially installed in the pad surface in a direction normal to the pad surface (and the floor surface). In a preferred mode, the microfibers are manufactured by installing the microfibers into a woven fabric by simply looping and knotting the microfiber into the fabric surface. The microfibers extend from the pad surface for a distance of about 0.1 to about 5 millimeters, typically about 0.1 to about 2 millimeters. About 50 to about 80% of the area microfibers per square centimeter of the pad surface as microfibers, preferably about 70 to about 80% fibers per square centimeter for easy, low force but high add-on application of the floor finish materials.

The internal foam reservoir formed within the application pad of the invention can typically contain about 30 to about 85 milliliters of floor finish per square meter of pad. The pad is typically a small open celled foam structure, having a thickness, before compression during manufacturing that can range from about 0.2 to about 2 centimeter in thickness.

The microfiber systems are small fibers having a dimension of about 0.2 to about 5 denier, typically about 0.8 to about 1.5 denier. The microfibers are typically made from two relatively incompatible polymer materials, for example, polyester and polyamide. The fibers are coextruded and then split into microfilaments during manufacturing. The most common structure of the microfiber is a core structure with wedge shaped perimeter structures having a small, less than 0.5 denier aspect. The yarn made from the microfiber contains high surface area wedge shaped filaments and a core filament. The capillary effect between the wedge shaped filament and the core filament creates a very high absorbency which, in turn, permits the microfiber structures to absorb large amounts of floor finish and enables the pad to apply large amounts of floor finish to the floor with a quality finish having little or no defects in the finish surface. The preferred microfiber comprises about 80% polyethylene terephthalate polyester and about 20% polyamide such as a nylon.

The high solids floor finish compositions of the invention that can be used with the microfiber pad technology typically are formulated using an aqueous material in a dispersion or suspension form. Typically, the aqueous floor finish comprises an organic polymeric material augmented using a variety of other polymeric materials or additive compositions. Typically finish compositions are formulations that can include water-formulated coatings including aqueous polish compositions in either buffable, self polishing or non-buffable types, temporary protective coatings, or other well-known formulations types. These aqueous coatings can result in a substantially transparent coating after volatilization of the aqueous media. The formulations can include non-volatile, solid film forming polymeric materials dispersed in the aqueous media using dispersing or emulsifying materials to form a uniform aqueous formulation. Such emulsifier or dispersant materials including anionic or non-ionic agents are used in sufficient amounts to form a stable aqueous dispersion of the film forming polymeric materials in the aqueous media. Judicious formulation of such film forming materials at high solids content, permits the application of sufficient amounts of the film forming polymer to permit the formation of a thick robust coating in one application or pass. Such formulations can contain other components of organic or inorganic character in polymeric or non polymeric forms. Such floor finish can contain a plasticizer, a surfactant (wetting agent) or other additive material that facilitates the formation of a single smooth continuous floor finish layer. The film forming polymer material generally comprises a solid polymeric material that can be emulsified or dispersed in an aqueous media in combination with a wax, other polymer film formers, natural and synthetic resins including alkali soluble resins and other additive materials.

Representative examples and suitable natural and synthetic polymer materials include polymers comprising vinyl acetate, polymers comprising vinyl chloride or vinylidene chloride, polyurethane materials, copolymeric materials comprising butadiene, acrylonitrile, styrene, vinyl acetate, acrylic monomers, and in particular cross-linked acrylic systems including metal complexed or ionic cross-linked acrylic polymers. Other resins can include terpene materials, terpene-phenolic polymers and others. Representative examples of commercially available polymeric floor finish materials can be obtained from Rhom & Haas or SC Johnson Co.

Floor finish formulations of the invention can be manufactured by combining the film forming polymer with an additive package including a plasticizer material Both permanent and fugitive plasticizers can be incorporated for many applications. Representative examples of fugitive plasticizers are diethylene glycol (carbitol materials), ethylene glycol, ethylene glycol alkyl ether, benzyl alcohol and ethers thereof, and other such liquid materials. Permanent plasticizer materials include phthalate plasticizers, fatty acid esters of polyols, benzoate esters, tricresyl phosphate, and others. Plasticizers selected for use in formulations of the invention are chosen in accordance with compatibility and efficiency introducing the floor finishes of the invention at application temperatures.

Additive materials can also be used in the finish compositions of the invention. Such additives commonly include surfactant and wetting agent compositions. Other additives can comprise preservatives, sanitizers, antifoaming agents, fragrances, pigments or dyes, leveling agents and other additives.

An important aspect of the floor finish formulations of the invention relates to the amounts of materials present in the floor finish. The preferred compositions are formulated by combining aqueous preparations of the film forming polymer material, additives, and other film forming ingredients. The total amount of each material in the aqueous solution is adjusted to provide from about 28 to 45 wt %, preferably 30 to 40 wt % total solids based on the floor finish composition taken as a whole.

A preferred useful formulation for use in the floor finish systems of the invention is as follows:

TABLE

Ultra High Solids Finish

| General Description | Range |
|---|---|
| Water | 0–20% |
| Fluorocarbon wetting agent | 0.02–0.2% |
| Silicone defoamer | 0.02–0.2% |
| Glycol ether | 5–9% |
| Tributoxyethyl phosphate | 2–5% |
| Preservative | 0.1–1% |
| Surfactant | 0–2% |
| Polyacrylate emulsion (38%) | 55–75% |
| Resin | 0–7% |
| Polyethylene/polypropylene wax (30–40%) | 5–15% |

Embodiments of the Method

In an embodiment, the present invention includes a method of forming a floor finish layer on the resilient vinyl floor. This method comprises applying an aqueous floor finish composition to a resilient vinyl floor, the floor finish composition comprising greater than about 30 wt.-% solids, at a rate of addition of floor finish of about 30 to 90 milliliters of aqueous floor finish per each square meter of the floor; and forming a substantially uniform dried floor finish layer having a thickness of about 0.01 to 0.03 mm and about 10 to 35 gm-m$^{-2}$ of dried floor finish on the resilient vinyl floor.

In an embodiment, the present invention includes a method wherein the floor finish composition comprises about 30 to 40 wt.-% solids.

In an embodiment, the present invention includes a method wherein the floor finish is applied to the floor surface at a rate of about 3.0 to 10 m$^2$-min$^{-1}$.

In an embodiment, the present invention includes a method wherein the floor finish layer has a thickness of about 0.01 to 0.03 mm.

In an embodiment, the present invention includes a method wherein the dried floor finish layer comprises about 15 to 30 gm-m$^{-2}$.

In an embodiment, the present invention includes a method wherein the floor finish layer comprises a layer formed by a single application of the liquid floor finish material.

In an embodiment, the present invention includes a method in which the floor finish is applied by metering about 35 to 80 milliliters of aqueous floor finish onto a floor surface and distributing the aqueous floor finish using a microfiber pad, wherein the application and distribution step are repeated at least once.

In an embodiment, the present invention includes a method wherein the floor finish is applied from a portable unit that is replenished with aqueous floor finish.

In an embodiment, the present invention includes a method wherein the portable unit comprises a back pack configured to contain 5 to 15 liters of floor finish.

Embodiments of the System

In an embodiment, the present invention includes a system capable of forming a floor finish layer on a resilient vinyl floor. This system comprises a portable container for liquid floor finish having a reservoir of about 5 to 20 liters, the container comprising a coupling providing fluid communication to a wand applicator; a wand applicator comprising a handle, an applicator pad and a conduit providing fluid communication of floor finish from the container to the applicator pad; and means to meter about 30 to 90 milliliters of the aqueous floor finish composition onto each square meter of the resilient vinyl floor.

In an embodiment, the present invention includes a system wherein the portable container comprises a backpack comprising a case adapted for supporting a container of liquid floor finish.

In an embodiment, the present invention includes a system wherein the coupling comprises a rotary coupling.

In an embodiment, the present invention includes a system wherein fluid communication from the container to the wand applicator comprises a coupling and conduit.

In an embodiment, the present invention includes a system wherein the handle comprises means to meter the aqueous floor finish.

In an embodiment, the present invention includes a system wherein the applicator pad comprises a substantially planar pad having an attachment surface, an interior foam reservoir and a microfiber application surface.

In an embodiment, the present invention includes a system wherein the pad a substantially rectangular having a surface area of about 500 to 2000 cm.

In an embodiment, the present invention includes a system wherein the microfiber comprises an absorbing yarn comprising about 70 to 90 percent polyester and 10 to 30 percent polyamide.

In an embodiment, the present invention includes a system wherein the case comprises a hose restraint.

In an embodiment, the present invention includes a system wherein means to meter the floor finish comprises an aperture having a diameter of about 0.1 to 3 mm.

In an embodiment, the present invention includes a system wherein the attachment surface comprises a Velcro surface and foam reservoir comprises a an open cell foam having a thickness of less than 2 cm.

Detailed Description of the Drawings

The invention uses a portable application system such as a back pack container for the floor finish. Such container is fluidly communicated to an applicator wand through a conduit. The applicator wand comprises a valve that can help to meter the floor finish onto the floor, through a metering nozzle, a distribution pad and a floor finish conduit. The following Figures details the mechanical aspects of the floor finish application equipment of the invention. Within the Figures common numbering is used for identical elements in the Figures.

FIG. 1 is a depiction of one embodiment of a portable unit of the invention comprising a back pack of the invention. The back pack 100 comprises a case 102 and a movable or openable lid 101 that can be opened to install or remove a floor finish container (not shown, see FIGS. 3 and 6). The floor finish container is fluidly coupled to a conduit 103 which can provide a pathway for the floor finish liquid. In the operation of the back pack, the lid 101 is opened to reveal either a space for the installation of a container or the installed container in place inside the back pack. The container is either introduced or replaced with fresh finish containing material and the opening is closed. The conduit is then connected to the application wand for application of the floor finish.

Figure 2:
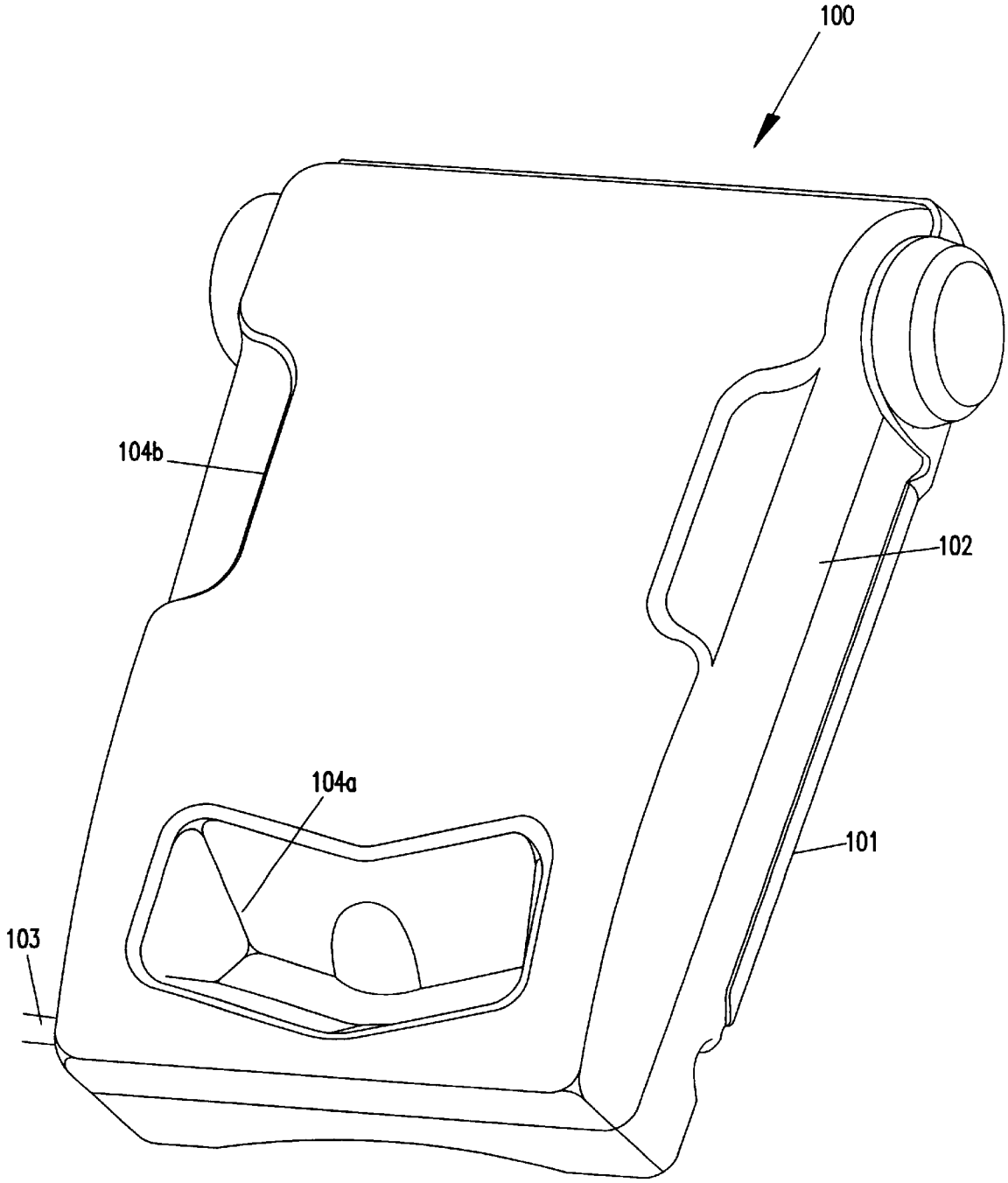
FIG. 2 is a depiction of a reverse view of the back pack of FIG. 1.

FIG. 2 is a depiction of the reverse side of the back pack 100 of the invention. In FIG. 2 is shown the closed lid 101 and the case 102. The conduit 103 is shown extending from the edge of the case 102. On the reverse side of the case 102 of the invention is shown recess or indentation supports 104*a* and 104*b* formed in the case to support the introduction of the floor finish container (not shown, see FIGS. 3 and 6) into case 102. The case 102 is manufactured preferably from a thermoplastic material that can be made with predetermined molded support surfaces for the container. Indents 104*a* and 104*b* provide both a lock and key security feature and to support the filled container of liquid floor finish.

Figure 3:
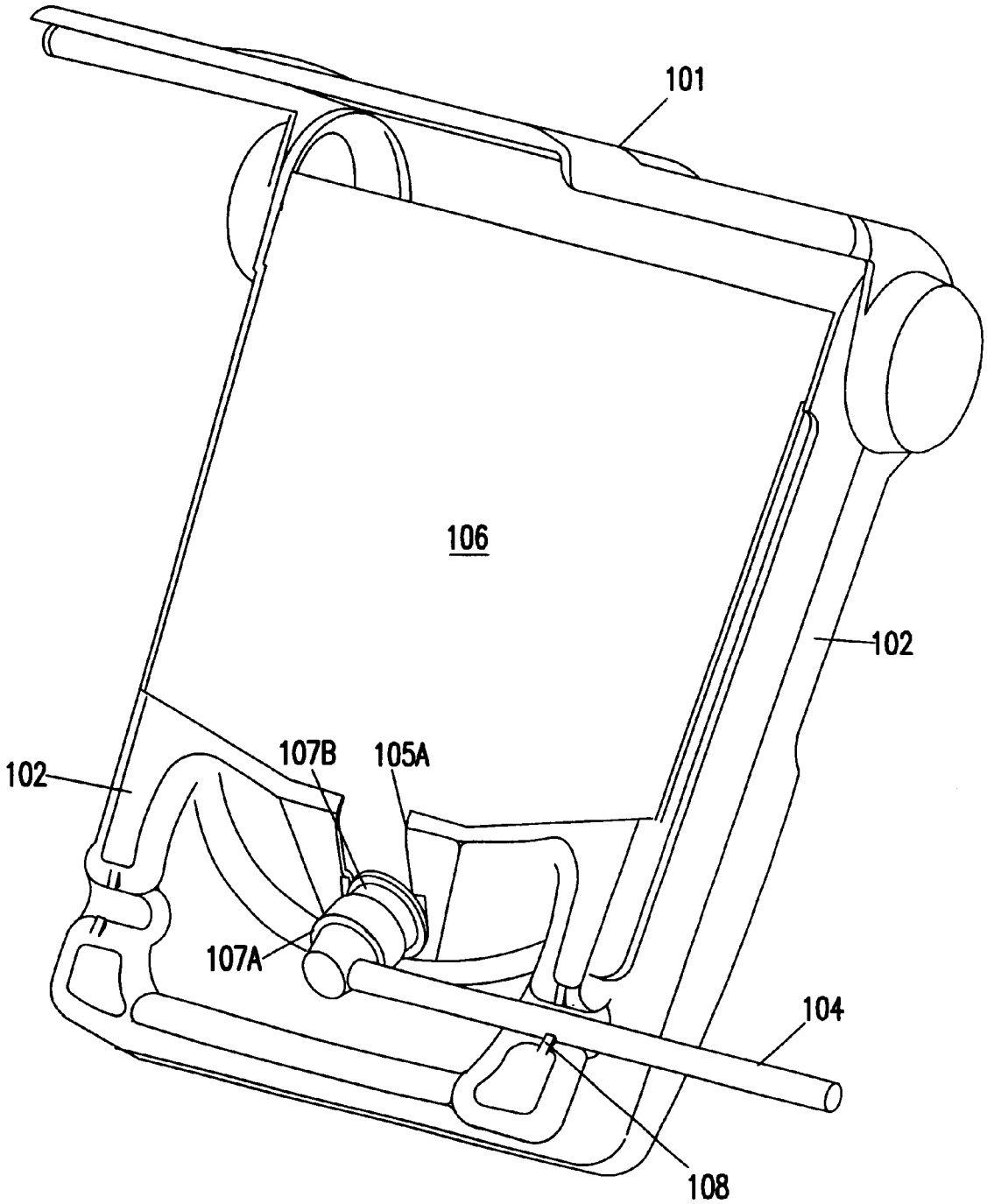
FIG. 3 is a depiction of the back pack of FIG. 1 with a movable lid or opening adapted or positioned to reveal the floor finish composition or container supported by the support surface formed in the interior of the portable unit or back pack. The container can comprise a flexible or rotatable coupling and a conduit that can be in fluid communication with an application wand.

FIG. 3 is a depiction of the opened back pack of the invention. In FIG. 3, the lid 101 is shown in an open position (not necessarily fully opened). The container 106 is shown inserted into the container or case 102. The container 106 is supported within the case 102 by support surface 105*b* and other support surfaces within the molded placement for the container 106 within case 102. The container is equipped with a coupling structure 107*a* and 107*b* that permits the conduit 103 to conduct floor finish from container 106 to the application wand (not shown). The conduit 103 is held in place in the back pack 102 by conduit restraint 108 that restrains the conduit in place in the back pack during operation. The back pack 100 is adapted for use by left handed or right handed application personnel by forming a conduit restraint 108 on either side of the back pack (both left and right). The back pack is adapted for easy replacement of container 106 by unattaching the conduit 103 from the application wand and simply removing container 106 from the case 102 taking care to remove and install the container 106 without damage to the coupling 107*a* and 107*b*.

Figure 4:
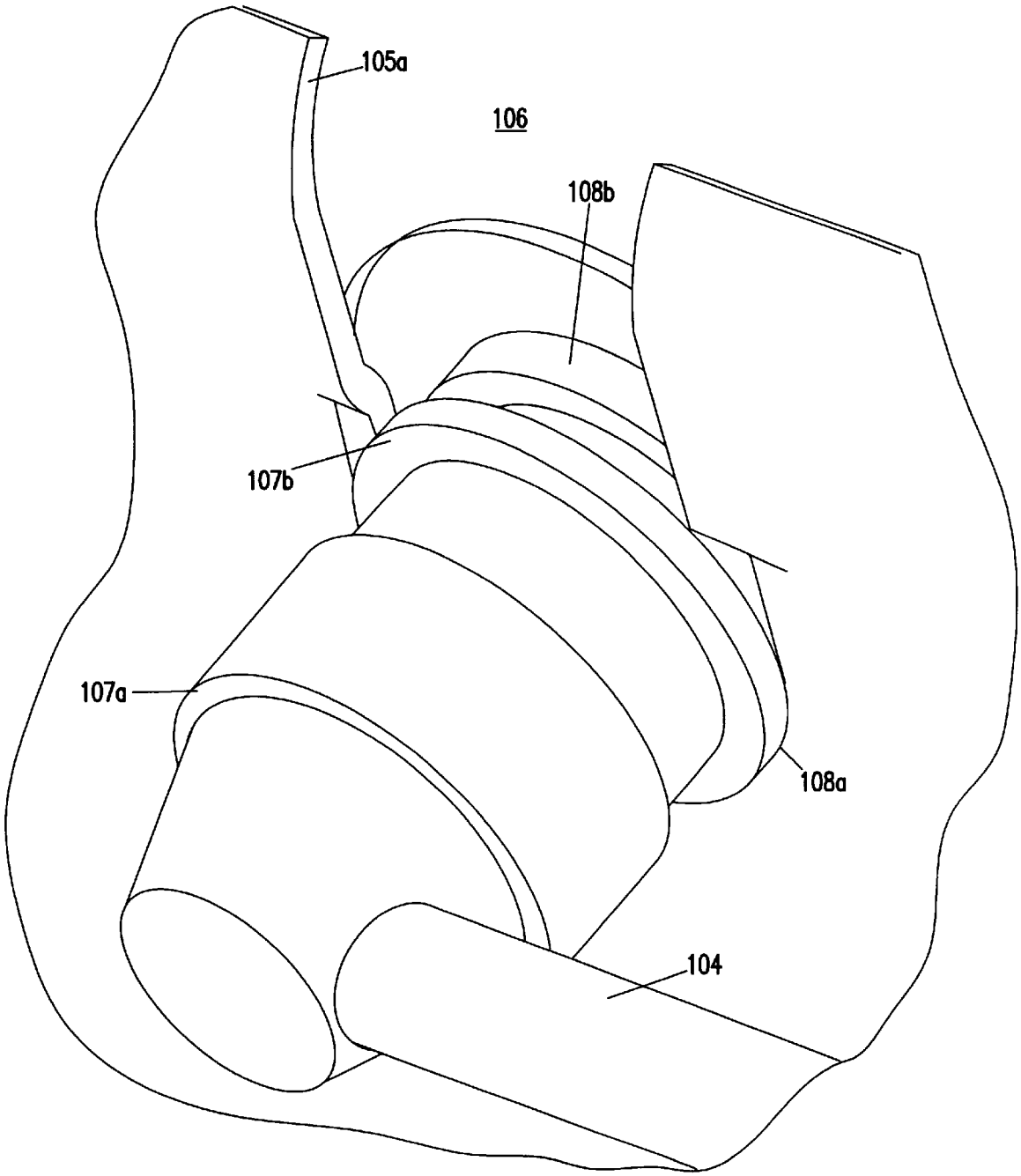
FIG. 4 is a depiction of the flexible coupling assembly that transfers liquid floor finish from the container to the conduit.

FIG. 4 is a close up view depicting the coupling 107*a* and 107*b*, attached to the container 106 and installed in the support structure 105*a* and 105*b*. The fluid coupling 107*a* and 107*b* for fluid communication of the floor finish from container 106 to conduit 103 is accomplished using a two part coupling structure. The coupling structure comprises a rotary cap 107*a* and a container aperture device 107*b* with mounting rings 108*a* and 108*b*. When the container 106 is installed in the back pack 102 on the support surface 105*b*, the container aperture device is installed into an opening 105*a* that is gripped by the rings 108*a* and 108*b* of the container aperture device 107*b*. The ring structure 108*a* and 108*b* of aperture device 107*b* maintains the container 106 fixedly in place in the back pack 102. The container aperture device provides a fluid communication from the container through the aperture 107*b* to the rotary cap 107*a* and the high solids floor finish readily passes from the container through the aperture into the rotary cap and then through the conduit 103 to the application wand (not shown). In FIG. 4, ring 108*a* and ring 108*b* form a gripping surface that grips opening 105*a* to maintain the container in position.

Figure 5:
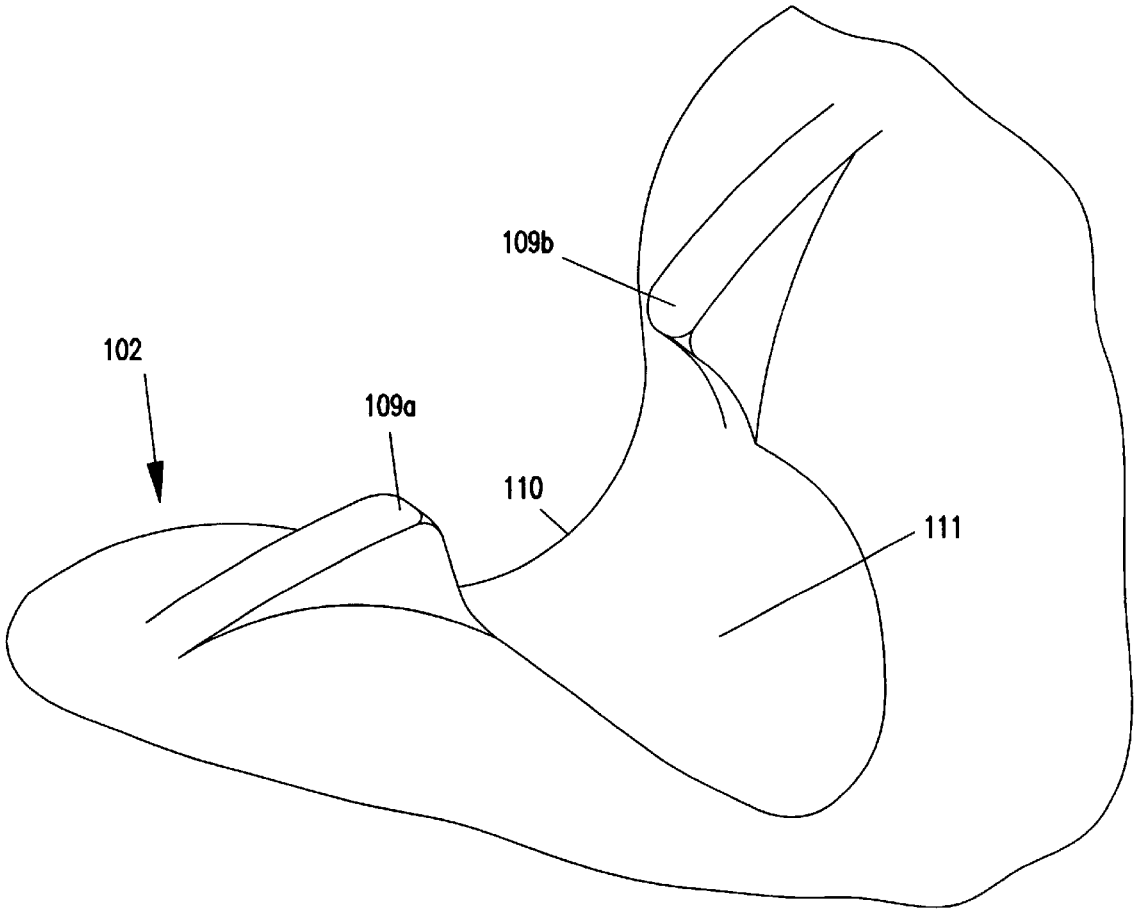
FIG. 5 is a depiction of a station formed in the back pack housing or case used as a conduit restraint or holder to fix the conduit in predetermined position and to restrain the conduit from motion during the application of the floor finish.

FIG. 5 shows details of the conduit restraint system. The restraint system comprises edges 109*a* and 109*b*, indentation 110 and surface 111 formed back pack 102. As shown in FIG. 3, the back pack comprises a conduit 103 (not shown) restraint 109*a* and 109*b* installed in either the left hand or right hand aspect of back pack 102. A recess 110 provides a location for the conduit of the invention while restraint edges 109*a* and 109*b* maintain the conduit against the recess 110. The profile of surface 111 in the molded portion of the back pack 102 provides a location for the conduit 103 that ensures the conduit is not bent to obstruct flow of the floor finish. The container restraint structure compresses the hose or conduit by about 5% or less to ensure that the hose or conduit is restrained by the structure.

Figure 6:
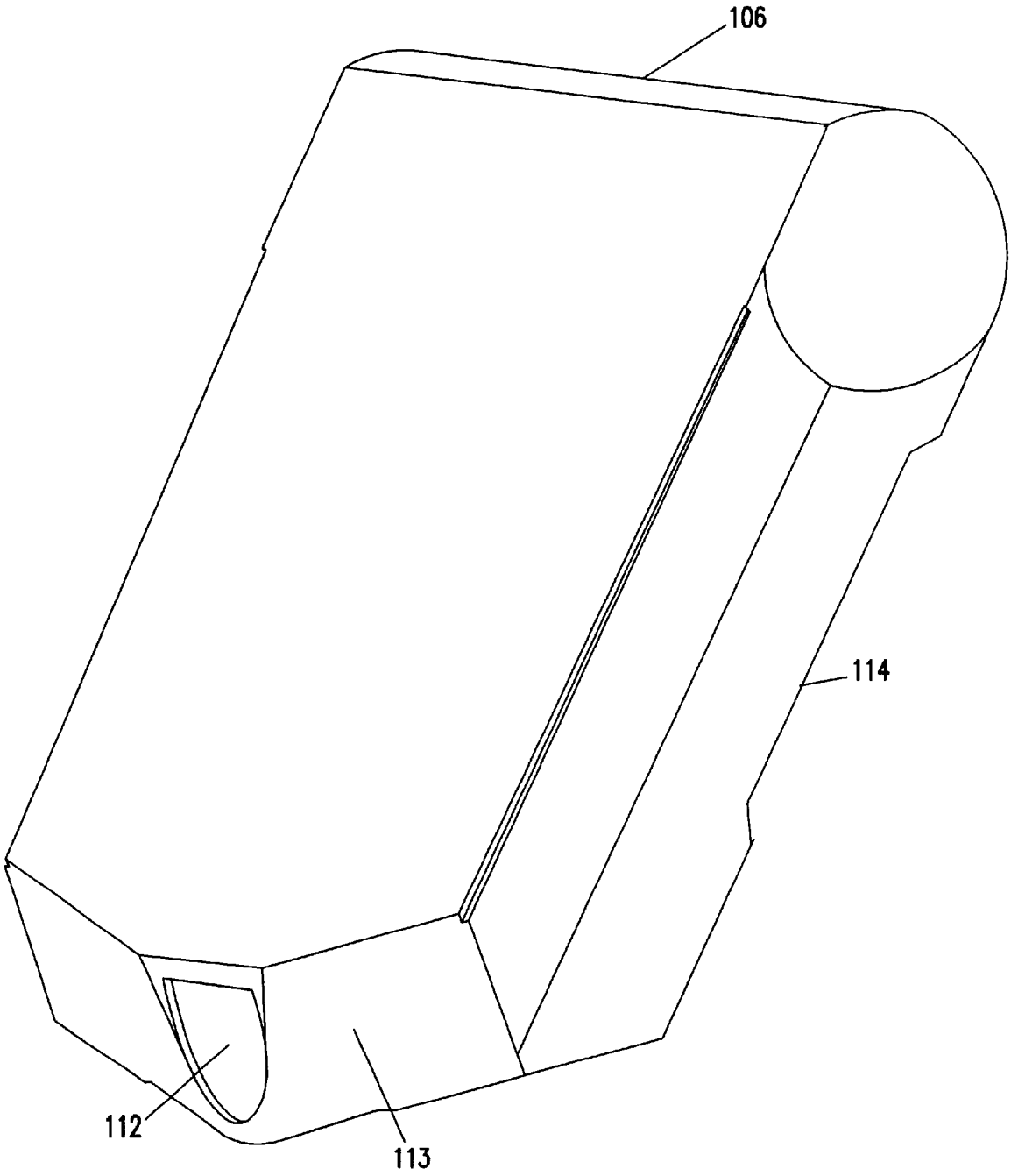
FIG. 6 is a depiction of the external shape of one embodiment of a floor finish container showing a conduit installation surface.

FIG. 6 is a depiction of the floor finish container 106 of the invention. The floor finish container is adapted to closely fit the internal space within the case 102. The external surfaces of the container 106 are complementary to the inside surfaces of the case 102. In particular, surface 114 and 113 are adapted for the support structures or surfaces 105 formed in the case that closely fit the container 106 to ensure that the container is well maintained within the case during application of the floor finish. The container has a coupling attachment surface 112 that provides a location for the installation of the coupling device 107*a* and 107*b* for the conduit 103.

Figure 7:
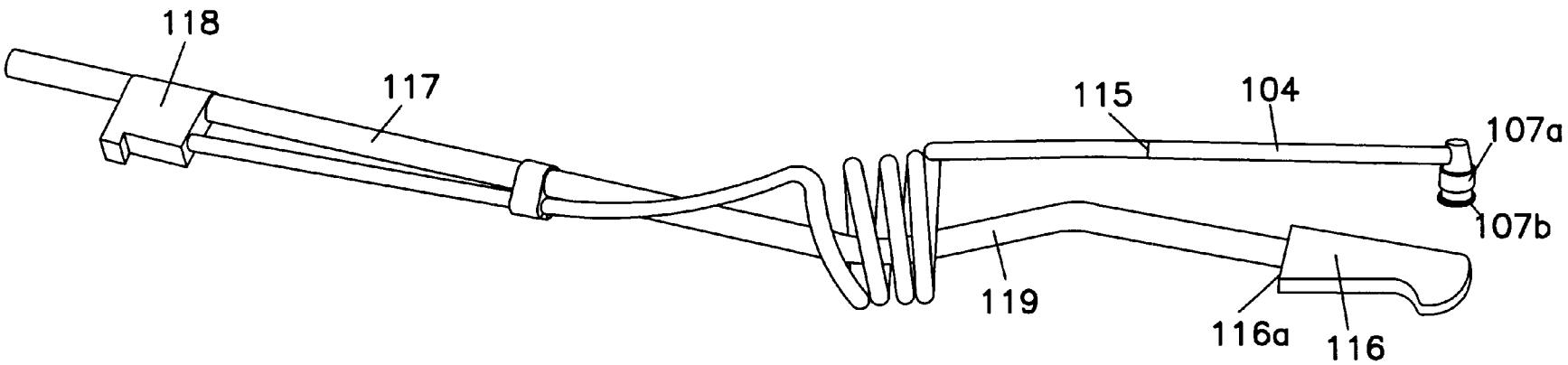
FIG. 7 is a depiction of the application wand used in conjunction with the portable unit or back pack. The conduit arising from the container of liquid floor finish material is coupled to a flexible conduit associated with the application wand that carries the floor finish from the container conduit for a coupling to the applicator nozzle. The wand also acts as a carrier for the liquid floor finish metering means and the distribution pad.

FIG. 7 is a detail depiction of application wand 119 of the invention. In the application of the floor finish of the invention, the conduit device 107*a* and 107*b* are installed onto the container 106 (not shown) within the back pack of the invention. The conduit 103 extends to a coupling 115 that fluidly couples a flow of the floor finish to a hose 117 that conducts the floor finish to the applicator nozzle metering port 118. The handle 116 is installed with a trigger 116*a* that is adapted to trigger a release of the floor finish from the metering port 118 to ensure that a substantial proportion of the high solids floor finish is applied to the floor for distribution.

Figure 8:
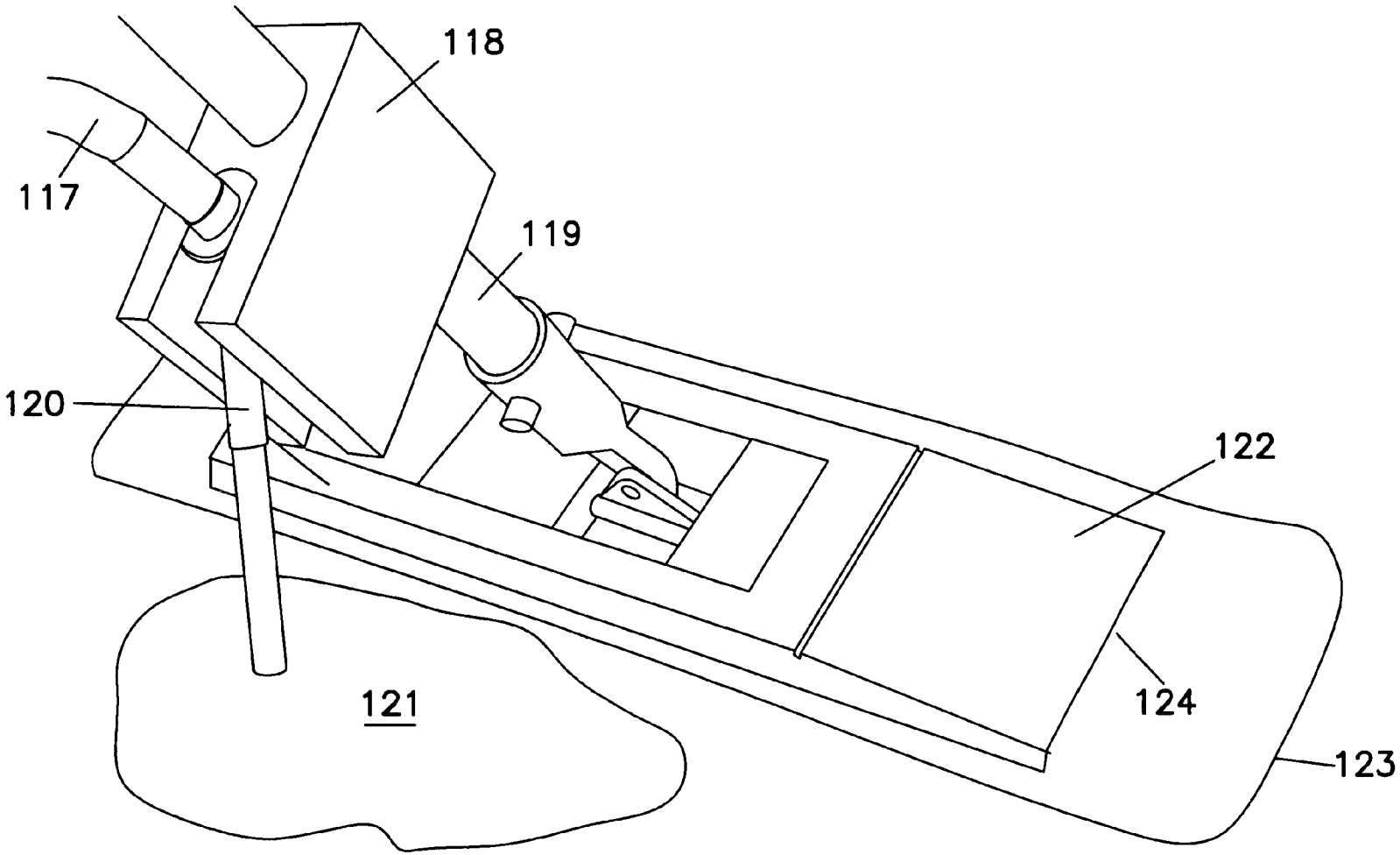
FIG. 8 is a depiction of the distal end of the application wand.

FIG. 8 is one embodiment of the distal, applicator portion of wand of the invention. In FIG. 8 is shown the wand having installed on the wand 119 a metering port 118 and an applicator nozzle 120. Floor finish is delivered to the application nozzle 120 through conduit 117. When the flow of the finish is triggered by trigger 116*a* (not shown), a volume of the floor finish is released through nozzle 120 onto the floor. The liquid 121 is then distributed by the pad. The applicator pad 123 is installed onto a pad attachment 122 that provides a support surface for the pad 123. In this embodiment, the opposite ends of the attachment 122 are placed into pockets 124 formed in the pad 123 that maintains the pad on an installed position on the attachment 122 of the wand structures 119.

Figure 9A:
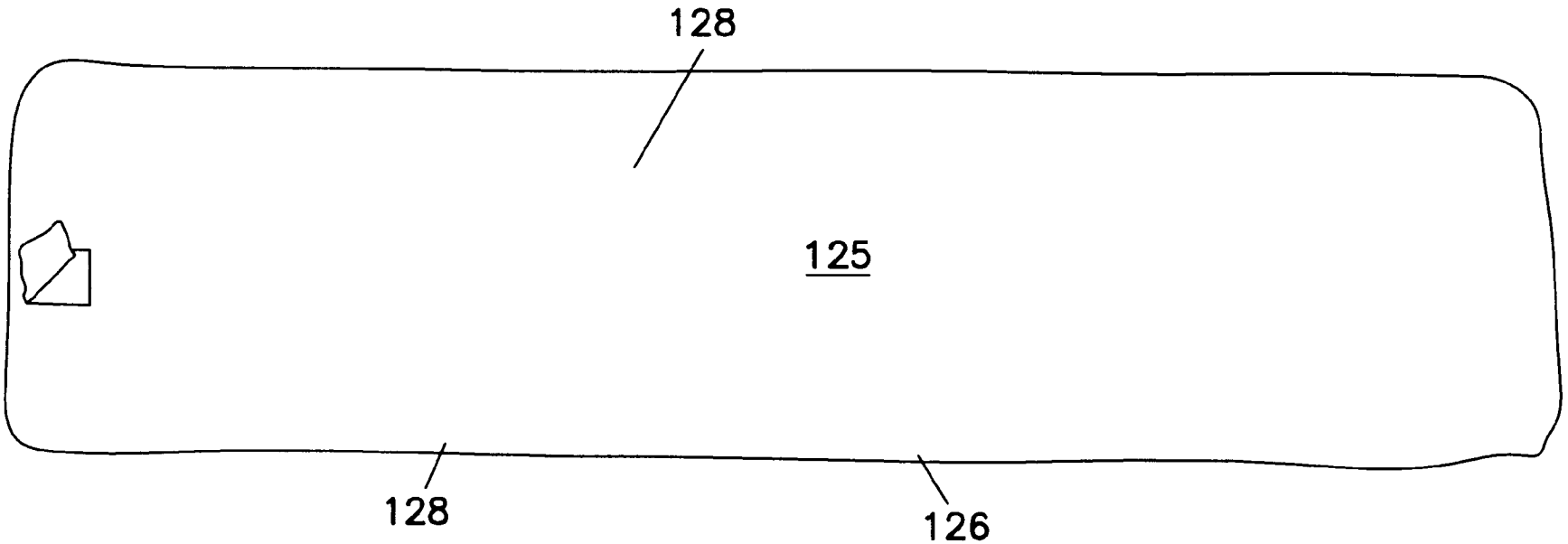
FIGS. 9A and 9B are a depiction of the attachment surface and application surface of the pad. Such a pad can use a VELCRO® (hook and loop fastener) surface for attachment to the wand assembly and, on the application or floor finish distribution surface of the pad, the pad can use a microfiber material installed into the application surface. The installed microfiber surface characteristics can be used to evenly distribute the floor finish on the resilient vinyl tile-flooring surface to form a thick resilient robust layer. The pad containing a reservoir comprising an internal polymeric open cell foam structure that can act to maintain a supply of the floor finish for high solids add-on to the floor surface.
Figure 9B:
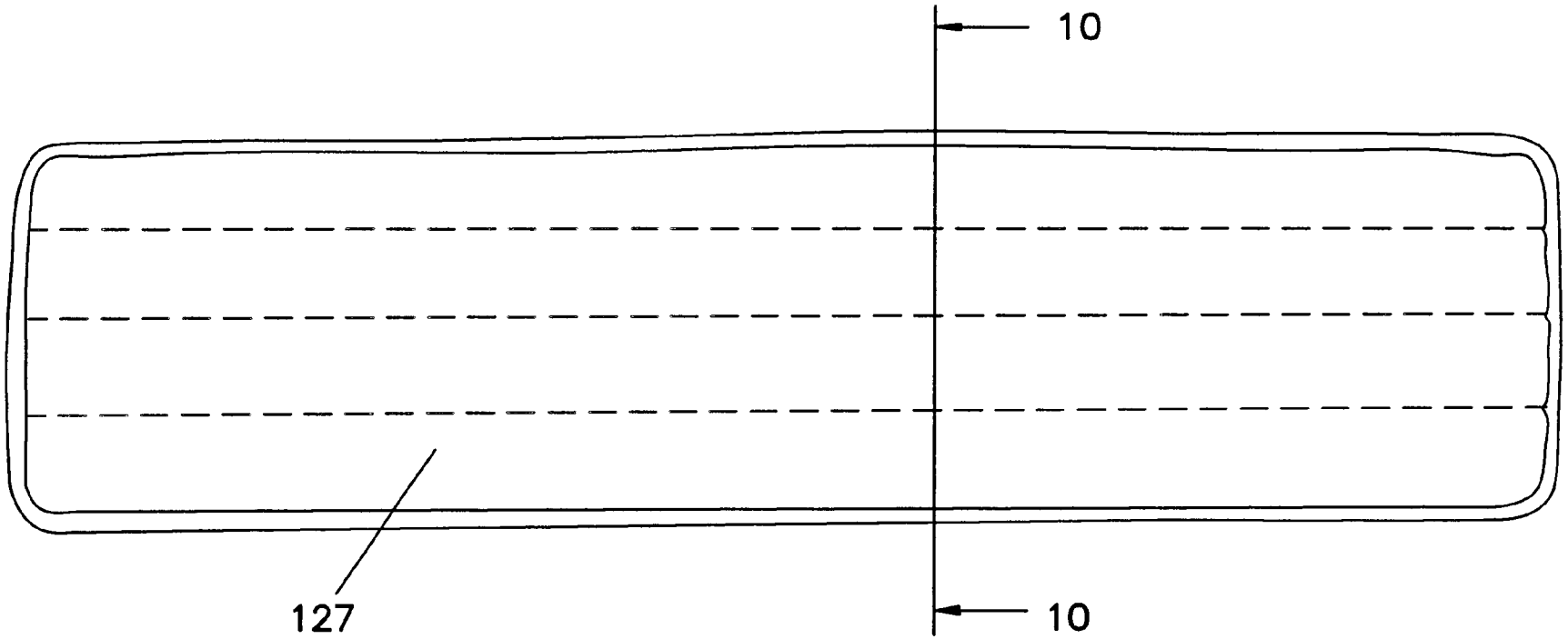

FIGS. 9A and 9B show an alternative embodiment of pad 123 involving a VELCRO® (hook and loop fastener) attachment. In FIG. 9A, the pad VELCRO® (hook and loop fastener) surface 125 is shown. The VELCRO® (hook and loop fastener) surface is sewn to the microfiber surface (see FIG. 9B) using a sewn attachment 128 and sewn perimeter 126. FIG. 9B shows the microfiber surface 127 having a distribution of microfibers installed into a woven or non-woven fabric used for floor finish distribution. Positioned between the VELCRO® (hook and loop fastener) attachment surface 125 and the microfiber surface 127 is a foam reservoir (not shown) having an internal volume sufficient to maintain a volume of the liquid floor finish.

Figure 10:
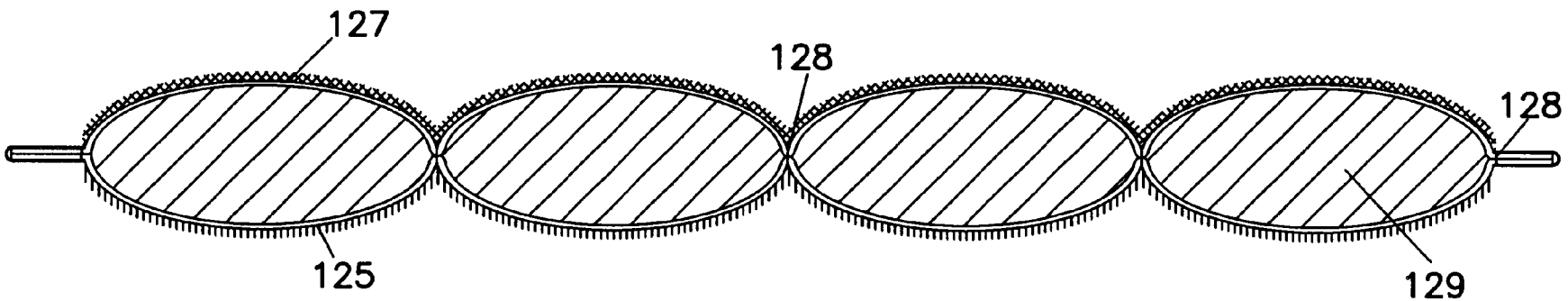
FIG. 10 is a depiction of a cross-section of a pad of the invention.

FIG. 10 is a depiction of a cross-section of the pad of the invention. In FIG. 10 is shown [in] the microfiber surface 127, the VELCRO® (hook and loop fastener) attachment surface 125, the internal foam reservoir section 129 that are all assembled using the stitched assembly structure 128.

EXPERIMENTAL

Example 1

Using the portable floor finish unit shown in the Figures, an aqueous floor finish composition:

| General Description | Range |
|---|---|
| Water, soft | 8.15 |
| Zonyl FSJ | 0.05 |
| SWS 211 | 0.03 |
| Diethylene glycol methyl ether | 6.00 |
| Texanol | 1.50 |
| KP-140 | 1.20 |
| Kathon CC/ICP | 0.07 |
| Rhopex B-1162 (Rohm & Haas) | 68.00 |
| Conrez 500 (25%) | 4.00 |
| AC-325 (35%) | 5.00 |
| AC-540 (40%) | 6.00 |
| TOTAL | 100.00 |

was applied to a resilient vinyl floor, in one application, at an add on amount of about 3.8 liters (1 gallon) per each 30 $m^2$ (about 1000 $ft^2$). The applied aqueous material was allowed to dry to a glossy film having a thickness of about 0.01 mm.

Example 2

Using the portable floor finish unit shown in the Figures, an aqueous floor finish composition:

| General Description | Range |
|---|---|
| Water, soft | 16.25 |
| Zonyl FSJ | 0.05 |
| SWS 211 | 0.03 |
| Diethylene glycol ethyl ether | 5.40 |
| Dipropylene glycol methyl ether | 1.50 |
| KP-140 | 1.70 |

-continued

| General Description | Range |
|---|---|
| Kathon CG/ICP | 0.07 |
| MorGlo 2 (Omnova) | 60.00 |
| Conrez 500 (25%) | 6.00 |
| AC-325 (35% | 4.00 |
| AC-540 (40%) | 5.00 |
| TOTAL | 100.00 |

was applied to a resilient vinyl floor, in one application, at an add on amount of about 3.8 liters (1 gallon) per each 30 $m^2$ (about 1000 $ft^2$). The applied aqueous material was allowed to dry to a glossy film having a thickness of about 0.03 mm.

Certain structures, materials of construction or claim elements have been described using a set of nomenclature consistent with the description of the invention. While the nomenclature using this application is adequate for the description found herein, the description includes alternative language or synonyms that can also used to describe the structures materials of construction or claim elements. Simply substituting a synonym is not resolve the use of this structure in infringement mode.

While embodiments of this invention as described in this specification drawings are fully capable of applying the greatest liquid floor finish of the invention in one application to form a thick robust floor finish, and achieve all the purposes object and aspect of the invention desired, the invention is not limited solely to the structures described in the invention disclosure and drawings that are provided for illustration purposes. As such, the invention is found in the claims hereinafter appended.

We claim:

1. A system for forming floor finish layer comprising:

backpack configured to hold container of liquid floor finish; the container having volume of up to about 20 liters;

wand applicator comprising handle, applicator, and conduit; the conduit providing fluid communication of floor finish from the container to floor;

the applicator comprising pad;

the pad being substantially planar and comprising attachment surface, interior foam reservoir, and application surface;

the application surface comprising microfiber; and metering valve configured to controllably provide fluid communication of floor finish through the conduit and to release floor finish onto the floor between the applicator and the handle.

2. The system of claim 1, configured to apply single coat, thick robust floor finish in single pass.

3. The system of claim 1, wherein the backpack comprises case configured for supporting the container of liquid floor finish.

4. The system of claim 1, wherein the backpack comprises openable lid.

5. The system of claim 1, wherein the backpack comprises interior profiled to fit the container.

6. The system of claim 1, wherein the backpack is configured to hold container having volume of about 5 to about 20 liters.

7. The system of claim 1, further comprising coupling coupled to the conduit and configured for coupling to the container.

8. The system of claim 7, wherein the coupling comprises rotary coupling.

9. The system of claim 1, wherein the conduit is positioned along and coupled to the wand.

10. The system of claim 1, comprising conduit within the wand.

11. The system of claim 1, further comprising trigger coupled to the handle, the trigger being configured to start and stop flow of the aqueous floor finish.

12. The system of claim 11, wherein the trigger is positioned proximal to the handle and end of the wand.

13. The system of claim 11, wherein the trigger is operably connected to the metering valve.

14. The system of claim 1, wherein the metering valve comprises metering orifice, the metering orifice defining aperture having diameter of about 0.1 to 3 mm.

15. The system of claim 1, wherein the metering valve is configured to provide about 30 to 90 milliliters of the floor finish composition onto each square meter of the floor.

16. The system of claim 1, further comprising container for liquid floor finish.

17. The system of claim 16, wherein the container comprises coupling coupled to the container.

18. The system of claim 16, comprising rigid, semi-rigid, or flexible container.

19. The system of claim 18, comprising flexible container.

20. The system of claim 1, comprising substantially rectangular pad having surface area of about 500 to 2000 $cm^2$.

21. The system of claim 1, wherein the microfiber comprises polyester microfiber.

22. The system of claim 1, wherein the attachment surface comprises hook and loop fastener surface and the foam reservoir comprises open cell foam having thickness of less than 2 cm.

23. The system of claim 1, comprising articulating coupling of applicator to wand.

24. The system of claim 23, wherein the articulating coupling comprises flexible linkage.

25. The system of claim 1, wherein the system is configured to apply the floor finish to resilient vinyl floor.

* * * * *